US009057349B2

(12) United States Patent
Fischer et al.

(10) Patent No.: US 9,057,349 B2
(45) Date of Patent: Jun. 16, 2015

(54) DECOUPLING ELEMENT FOR A FUEL INJECTION DEVICE

(75) Inventors: Michael Fischer, Niefern-Oeschelbronn (DE); Andrej Elsinger, Ditzingen (DE); Frank-Holger Schoefer, Murrhardt (DE); Corren Heimgaertner, Farmington Hills, MI (US); Michael Kleindl, Schwieberdingen (DE)

(73) Assignee: ROBERT BOSCH GMBH, Stuttgart (DE)

( * ) Notice: Subject to any disclaimer, the term of this patent is extended or adjusted under 35 U.S.C. 154(b) by 971 days.

(21) Appl. No.: 13/139,215

(22) PCT Filed: Nov. 26, 2009

(86) PCT No.: PCT/EP2009/065889

§ 371 (c)(1),
(2), (4) Date: Oct. 26, 2011

(87) PCT Pub. No.: WO2010/066586

PCT Pub. Date: Jun. 17, 2010

(65) Prior Publication Data

US 2012/0031375 A1 Feb. 9, 2012

(30) Foreign Application Priority Data

Dec. 12, 2008 (DE) ..... 10 2008 054 591

(51) Int. Cl.

| | |
|---|---|
| ***F02M 61/16*** | (2006.01) |
| ***F02M 61/14*** | (2006.01) |
| *F02M 55/00* | (2006.01) |

(52) U.S. Cl.

CPC ..... *F02M 61/14* (2013.01); *F02M 55/004* (2013.01); *F02M 2200/09* (2013.01)

(58) Field of Classification Search

CPC .. F02M 61/14; F02M 55/004; F02M 2200/09
USPC ..... 123/470, 456, 469, 468; 239/600
See application file for complete search history.

(56) References Cited

U.S. PATENT DOCUMENTS

| | | | |
|---|---|---|---|
| 6,009,856 | A | 1/2000 | Smith, III et al. |
| 2002/0162538 | A1 | 11/2002 | Krause et al. |

(Continued)

FOREIGN PATENT DOCUMENTS

| | | |
|---|---|---|
| CN | 101012797 | 8/2007 |
| DE | 10027662 | 6/2000 |

(Continued)

OTHER PUBLICATIONS

International Search Report, PCT International Patent Application No. PCT/2009/065889, Dated Mar. 22, 2010.

*Primary Examiner* — Mahmoud Gimie
(74) *Attorney, Agent, or Firm* — Kenyon & Kenyon LLP

(57) ABSTRACT

A decoupling element for a fuel injection device provides a low-noise construction. The fuel injection device has at least one fuel injection valve and a receiving bore in a cylinder head for the fuel injection valve as well as the decoupling element between a valve housing of the fuel injection valve and a wall of the receiving bore. The spring rigidity of the decoupling element is so low and the decoupling element is placed between the valve housing of the fuel injection valve and the wall of the receiving bore in such a way that the decoupling resonance is located in the frequency range below 2.5 kHz. The fuel injection device is particularly suitable for the direct injection of fuel into a combustion chamber of a mixture-compressing spark-ignited internal combustion engine.

10 Claims, 8 Drawing Sheets

(56) References Cited

U.S. PATENT DOCUMENTS

| | | | | |
|---|---|---|---|---|
| 2003/0145832 | A1 | 8/2003 | Reiter et al. | |
| 2004/0020470 | A1 | 2/2004 | Norgauer | |
| 2007/0175451 | A1 | 8/2007 | Beardmore | |
| 2007/0221176 | A1* | 9/2007 | Hardy | 123/470 |
| 2007/0228662 | A1 | 10/2007 | Reiter et al. | |
| 2008/0265520 | A1* | 10/2008 | Kurth | 277/549 |
| 2008/0302336 | A1* | 12/2008 | Fuerst et al. | 123/470 |
| 2008/0314366 | A1* | 12/2008 | Welzmueller et al. | 123/470 |
| 2008/0315019 | A1* | 12/2008 | Guerbaoui et al. | 239/585.5 |
| 2009/0050113 | A1* | 2/2009 | Liskow | 123/470 |
| 2009/0071445 | A1* | 3/2009 | Mueller et al. | 123/470 |

FOREIGN PATENT DOCUMENTS

| | | |
|---|---|---|
| DE | 10038763 | 8/2000 |
| DE | 10108466 | 2/2001 |
| DE | 102005057313 | 12/2005 |
| DE | 102004049277 | 4/2006 |
| EP | 1223377 | 7/2002 |
| EP | 1764501 | 3/2007 |
| WO | WO 2005/021956 | 3/2005 |
| WO | WO 2006/040227 | 4/2006 |

* cited by examiner

DECOUPLING ELEMENT FOR A FUEL INJECTION DEVICE

FIELD OF THE INVENTION

The present invention is based on a decoupling element for a fuel injection device.

BACKGROUND INFORMATION

FIG. 1 shows an example of a conventional fuel injection device, in which a flat intermediate element is provided on a fuel injection valve installed in a receiving bore of a cylinder head of an internal combustion engine. In a conventional manner, such intermediate elements are placed on a shoulder of the receiving bore of the cylinder head as supporting elements in the form of a washer. With the aid of such intermediate elements, manufacturing and assembly tolerances are compensated, and a mounting free of transverse forces is ensured even given a slightly oblique positioning of the fuel injection valve. The fuel injection valve is particularly suitable for use in fuel injection systems of mixture-compressing spark-ignited internal combustion engines.

Another type of simple intermediate element for a fuel injection device is described in German Patent Application No. DE 101 08 466 A1. The intermediate element is a support ring having a circular cross-section, situated in an area in which both the fuel injection valve and the wall of the receiving bore in the cylinder head run in the shape of a conical frustum, said ring acting as a compensating element for bearing and supporting the fuel injection valve.

Intermediate elements for fuel injection devices that are more complicated and significantly more expensive to produce are also described in, inter alia, German Patent Application Nos. DE 100 27 662 A1 and DE 100 38 763 A1, and European Patent No. EP 1 223 337 A1. These intermediate elements are distinguished in that they all have a multi-part or multilayer construction, and are intended in part to perform sealing and damping functions. The intermediate element described in German Patent Application No. DE 100 27 662 A1 has a base and carrier element in which a sealing means is set that is clamped by a nozzle element of the fuel injection valve. German Patent Application No. DE 100 38 763 A1 describes, a multilayer compensating element that is made up of two rigid rings and an elastic intermediate ring sandwiched between them. This compensating element enables both a tilting of the fuel injection valve relative to the axis of the receiving bore over a relatively large angular range and a radial shifting of the fuel injection valve out of the mid-axis of the receiving bore.

European Patent No. EP 1 223 337 A1 also describes a multilayer intermediate element, this intermediate element being made up of a plurality of washers made of a damping material. The damping material, made of metal, rubber, or PTFE, is selected and designed so as to enable a damping of the vibrations and noise produced by the operation of the fuel injection valve. However, for this purpose the intermediate element must have four to six layers in order to achieve the desired damping effect.

Damping elements in disk form for a fuel injector, in particular an injector for injecting diesel fuel in a common-rail system, are also described in German Patent Application No. DE 10 2005 057 313 A1. The damping disks are to be installed between the injection valve and the wall of the receiving bore in the cylinder head in such a way that even given high pressure forces a damping of structure-borne sound is enabled, so that noise emissions are reduced. An annular surface of the annular damping element abuts the support surface of the cylinder head, and a circumferential bulge of the damping element abuts the conical support surface of the injector. However, this overall system has the disadvantage that the support points of the damping element on the cylinder head and on the injector, regarded in the radial direction, are situated fairly close to one another, and the damping element is realized with a fairly high degree of rigidity due to its installation situation. This has the result that with the use of this system noise emissions are still present that can be heard clearly.

In addition, in order to reduce noise emissions, U.S. Pat. No. 6,009,856 A describes that the fuel injection valve be surrounded by a sleeve and that the resulting intermediate space be filled with an elastic sound-damping compound. However, this type of noise damping is complicated, difficult to install, and expensive.

SUMMARY

The example decoupling element according to the present invention for a fuel injection device may have the advantage that an improved noise reduction is achieved through decoupling or insulation with a very simple constructive design. In accordance with the present invention, the spring rigidity of the decoupling element is chosen to be low enough and the decoupling element is positioned between the valve housing of the fuel injection valve and the wall of the receiving bore in such a way that the decoupling resonance $f_R$ is in the frequency range below 2.5 kHz. In this way, the installation of the decoupling element in a fuel injection valve having injectors for direct fuel injection, in particular injectors operated with piezoactuators, results in a number of positive and advantageous aspects. The low rigidity of the decoupling element enables an effective decoupling of the fuel injection valve from the cylinder head, thereby significantly reducing the structure-borne sound power introduced into the cylinder head during noise-critical operation, and thus reducing the noise radiated by the cylinder head.

It may be particularly advantageous to realize the decoupling element in such a way that the two support areas of the decoupling element, in the radially outer and radially inner edge area, are situated as far from one another as possible, in such a way that a maximum possible lever arm results.

For this purpose, it may be advantageous if the receiving bore for the fuel injection valve are fashioned in a cylinder head and that the receiving bore have a shoulder that runs perpendicular to the extension of the receiving bore and on which the decoupling element is partly supported with its radially outer support area, and that the fuel injection valve in turn abut the radially inner support area of the decoupling element with an outer contour of the valve housing that runs perpendicular to the valve longitudinal axis.

Advantageously, the decoupling element may have the shape of an annular disc, and has an overall bowl or plate shape. The cross-section of the decoupling element has an S-shaped contour having two radii oriented toward the support areas. The installation can take place in both orientations of the decoupling element, i.e., in a bowl-shaped orientation with the bottom facing downward or in an inverted bowl orientation with the bottom facing upward.

Depending on whether it is used in an alternating pressure system or in a constant pressure system, the decoupling element is particularly advantageously designed so as to have a nonlinear progressive spring characteristic or a nonlinear degressive spring characteristic.

BRIEF DESCRIPTION OF THE DRAWINGS

Exemplary embodiments of the present invention are shown in simplified form in the figures and are explained in below.

DETAILED DESCRIPTION OF EXAMPLE EMBODIMENTS

Figure 1:
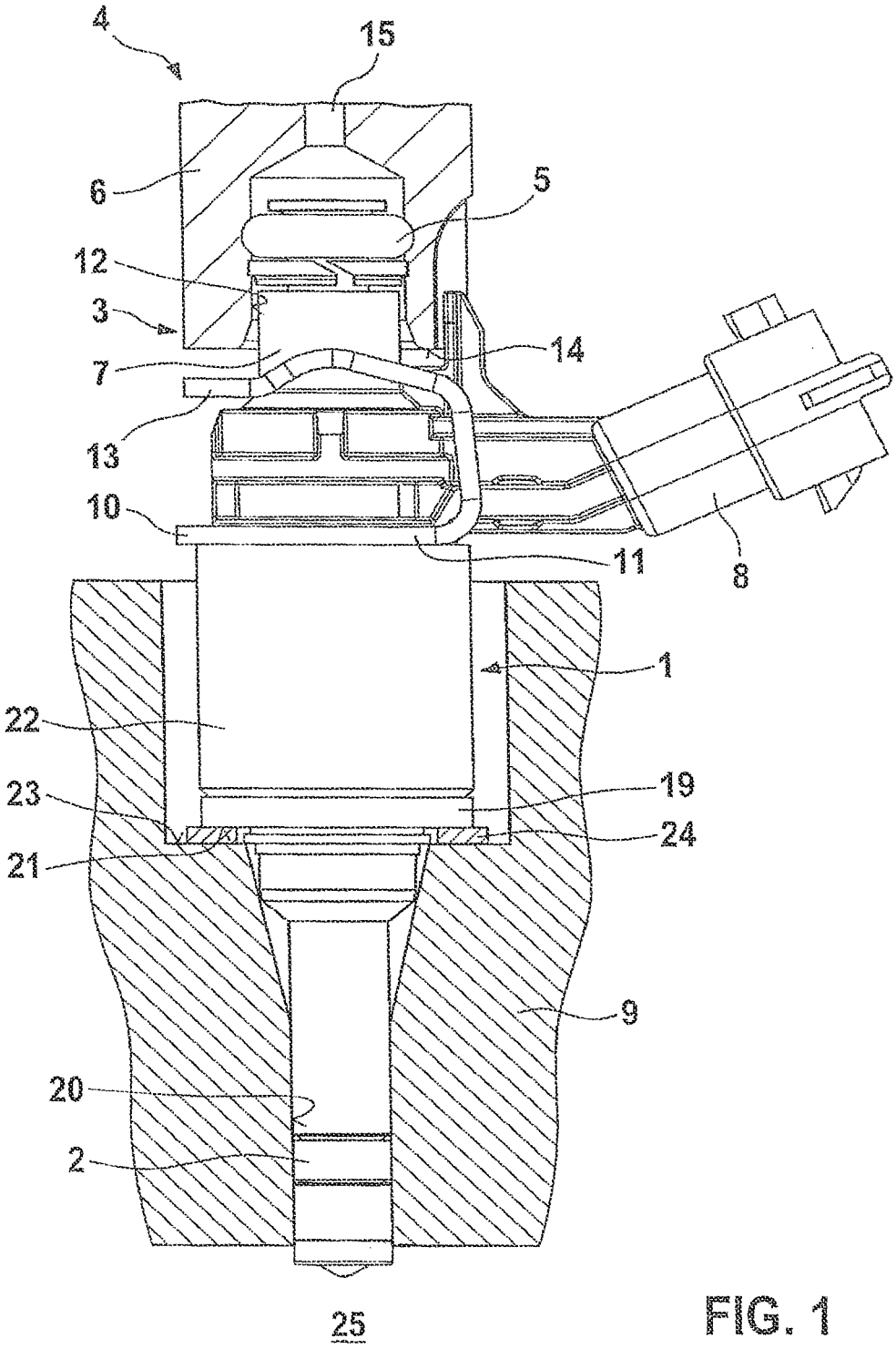
FIG. 1 PRIOR ART
FIG. 1 shows a partial view of a conventional fuel injection device having a disk-shaped intermediate element.

In order to explain the present invention, in the following, a specific embodiment of a conventional fuel injection device is described in more detail on the basis of FIG. 1. FIG. 1 shows, as an exemplary embodiment, a side view of a valve in the form of an injection valve 1 for fuel injection systems of mixture-compressing spark-ignited internal combustion engines. Fuel injection valve 1 is part of the fuel injection device. A downstream end of fuel injection valve 1, realized in the form of a direct-injecting injection valve for the direct injection of fuel into a combustion chamber 25 of the internal combustion engine, is placed into a receiving bore 20 of a cylinder head 9. A sealing ring 2, in particular made of Teflon®, provides an optimal sealing of fuel injection valve 1 against the wall of receiving bore 20 of cylinder head 9.

Between a protrusion 21 of a valve housing 22 (not shown) or a lower end face 21 of a support element 19 (FIG. 1) and a shoulder 23 of receiving bore 20 that for example runs at a right angle to the longitudinal extension of receiving bore 20, there is placed a flat intermediate element 24 realized in the form of a washer. With the aid of such an intermediate element 24, or together with a rigid support element 19, which for example has a contact surface that is curved inward toward fuel injection valve 1, manufacturing and installation tolerances are compensated and a mounting free of transverse forces is ensured even given a slightly oblique positioning of fuel injection valve 1.

At its inlet end 3, fuel injection valve 1 has a plug connection to a fuel distributor line (fuel rail) 4 that is sealed by a sealing ring 5 between a connector 6 of fuel rail 4, shown in section, and an inlet connection 7 of fuel injection valve 1. Fuel injection valve 1 is pushed into a receiving opening 12 of connector 6 of fuel rail 4. Connector 6 extends for example in one piece from the actual fuel rail 4 and has, upstream from receiving opening 12, a flow opening 15 having a smaller diameter through which the flow into fuel injection valve 1 takes place. Fuel injection valve 1 has an electrical plug connector 8 for the electrical contacting for the actuation of fuel injection valve 1.

In order to situate fuel injection valve 1 and fuel rail 4 at a distance from one another in a manner largely free of radial forces, and to hold fuel injection valve 1 securely in the receiving bore of the cylinder head, a holding-down device 10 is provided between fuel injection valve 1 and connector 6. Holding-down device 10 is realized as a bow-shaped component, e.g., a stamped bent part. Holding-down device 10 has a partially annular base element 11 from which a holding-down bow 13 runs out in bent-off fashion, said bow being seated against a downstream end surface 14 of connector 6 on fuel rail 4 in the installed state.

An object of the present invention is to achieve, in a simple manner, a noise reduction that is improved in comparison to the conventional solutions using intermediate elements and damping disks, above all in noise-critical idling operation, but also in constant-pressure systems when there is system pressure, through a specific design and geometry of intermediate element 24. The most significant source of noise of fuel injection valve 1 given direct high-pressure injection is the forces (structure-borne sound) introduced into cylinder head 9 during valve operation, which cause structural excitation of cylinder head 9 and are radiated by the cylinder head as airborne sound. In order to ameliorate this noise, it is therefore necessary to minimize the forces introduced into cylinder head 9. In addition to the reduction of the forces caused by the injection, this can be achieved by influencing the transmission characteristic between fuel injection valve 1 and cylinder head 9.

Figure 2:
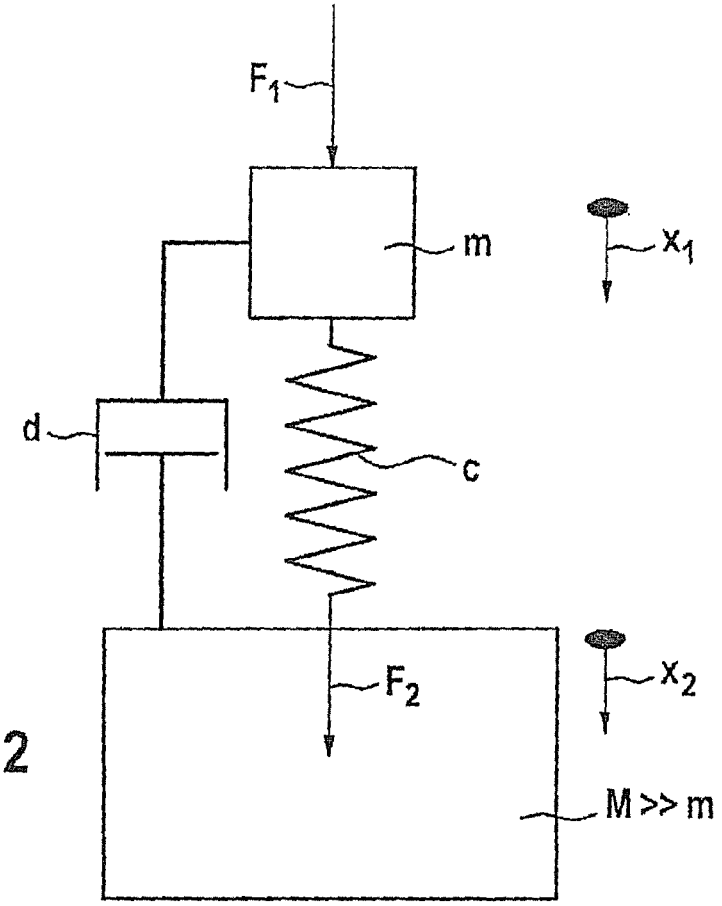
FIG. 2 shows a mechanical equivalent diagram of the supporting of the fuel injection valve in the cylinder head given direct fuel injection, depicting a standard spring-mass-damper system.

In the mechanical sense, the mounting of fuel injection valve 1 on passive intermediate element 24 in receiving bore 20 of cylinder head 9 can be represented as a standard spring-mass-damper system as shown in FIG. 2. Mass M of cylinder head 9 can be assumed, as a first approximation, to be infinitely large relative to mass m of fuel injection valve 1. The transmission characteristic of such a system is distinguished by an amplification at low frequencies in the range of the resonance frequency $f_R$ (decoupling resonance) and by an insulation range above the decoupling frequency $f_E$ (see FIG. 3).

On the basis of this transmission characteristic resulting from the spring-mass-damper system, a number of possibilities result for noise reduction:

1. Shifting the resonant frequency to lower frequencies, so that the insulation range covers as large a portion as possible of the audible frequency spectrum. This can be achieved by a lower rigidity c of intermediate element 24.

2. Increasing the damping characteristics (e.g., friction) of intermediate element 24 in order to achieve attenuation of the amplification at low frequencies. However, higher damping characteristics are accompanied by a reduction of the insulation effect in the higher frequency ranges.

3. A combination of the above two possibilities.

Figure 13:
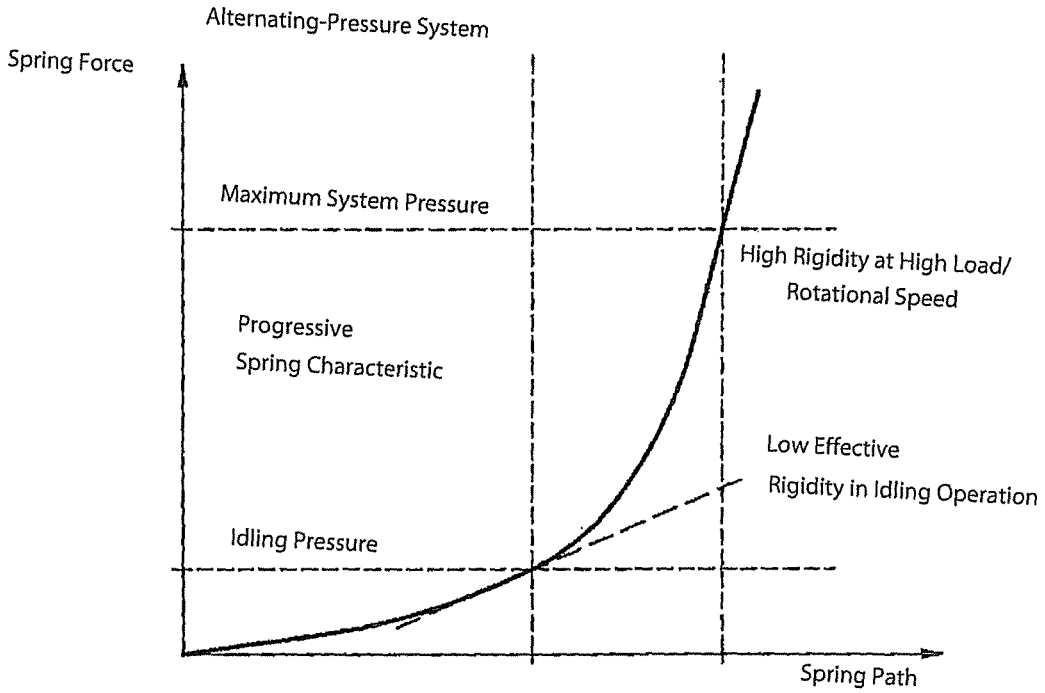
FIG. 13 shows a nonlinear progressive spring characteristic for a decoupling element according to the present invention that can be used in an alternating-pressure system.
Figure 14:
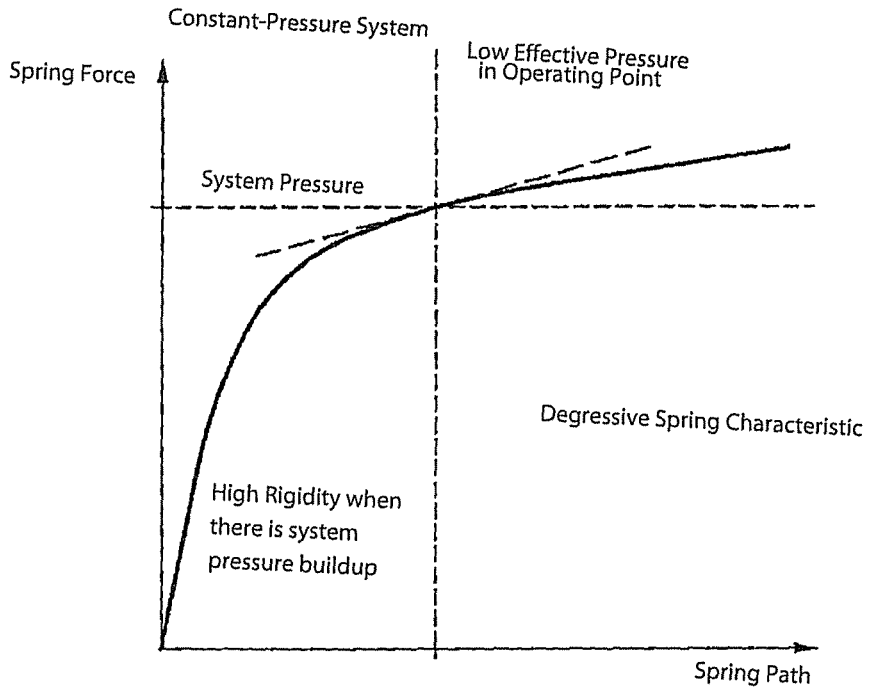
FIG. 14 shows a nonlinear, degressive spring characteristic for a decoupling element according to the present invention that can be used in a constant-pressure system.

One object of the present invention is to design an intermediate element 24, prioritizing the use of elastic insulation (decoupling) for noise reduction. The present invention includes on the one hand the definition and design of a suitable spring characteristic, taking into account the typical demands and boundary conditions present in direct fuel injection, and on the other hand the design of an intermediate element 24 that is capable of reproducing the characteristic of the spring characteristic defined in this way, and that can be adapted to the specific boundary conditions of the injection system by selecting simple geometric parameters. Concerning the spring characteristics, reference is made to FIGS. 13 and 14.

The decoupling of fuel injection valve 1 from cylinder head 9 with the aid of a low spring rigidity c of intermediate element 24, hereinafter designated decoupling element 240, is made more difficult by, in addition to the small constructive space, a limitation of the allowable maximum movement of fuel injection valve 1 during engine operation.

In the operation of fuel injection valves for fuel injection in internal combustion engines, the design causes variable forces to arise over a broad frequency range at the interface to the area surrounding the installation of said valves. These variable forces excite the surrounding environment to vibrations that are radiated as noise and that can be perceived. In order to avoid such noise, which is often experienced as disturbing, damping elements for vibration damping (energy dissipation) have been described (see "Background of the Invention" above), and are currently in use. In addition, these damping elements are often made up of various materials and individual parts.

Damping elements of the conventional types often aim at a reduction of the introduction of force through broadband energy dissipation, e.g., through microslippage or material damping in the interior of the damping element. However, the coupling of force between the fuel injection valve and its surrounding environment can be reduced only to a limited extent. Damping mechanisms are proportional to the shift or speed via the damping element, for whose origination a force must be present that is thereby introduced into the structure via the damping element.

Figure 3:
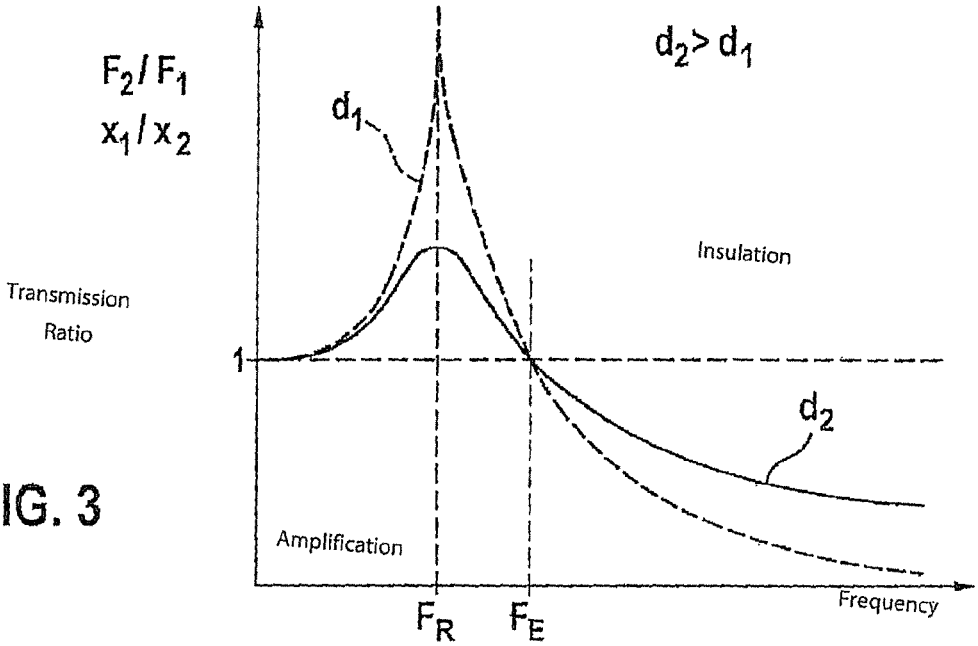
FIG. 3 shows the transmission characteristic of a spring-mass-damper system shown in FIG. 2, with amplification at low frequencies in the range of the resonance frequency $f_R$ and an insulation range above the decoupling frequency $f_E$.

In contrast, with the aid of a decoupling element 240 according to the present invention, the flow of force from fuel injection valve 1 can be largely suppressed over a large frequency range above decoupling resonance $f_R$. Here, decoupling resonance $f_R$ can be shifted to a frequency range in which the resonant amplification is largely masked by other components of engine noise (FIG. 3).

According to the present invention, decoupling element 240 is distinguished in that it acts to reduce the flow of force between fuel injection valve 1 and its surrounding environment, with the goal of reducing undesired noise excitation in the surrounding structure. The specific embodiments described below of decoupling elements 240 include the respectively advantageous form of the spring characteristic given the geometrical shape and choice of material of decoupling element 240; i.e., a progressive characteristic for the case of constant-pressure systems and a degressive characteristic for alternating pressure systems.

Thus, the design and installation situation of decoupling element 240 are primarily directed at achieving the effect of vibration decoupling, and not vibration damping. Decoupling element 240 is designed with regard to its rigidity characteristics, and not, as in conventional damping disks, with regard to its damping behavior. Damping, e.g. in the form of plastic or elastomer layers, can however also be used as a supplement to control the decoupling resonance $f_R$.

Figure 4:
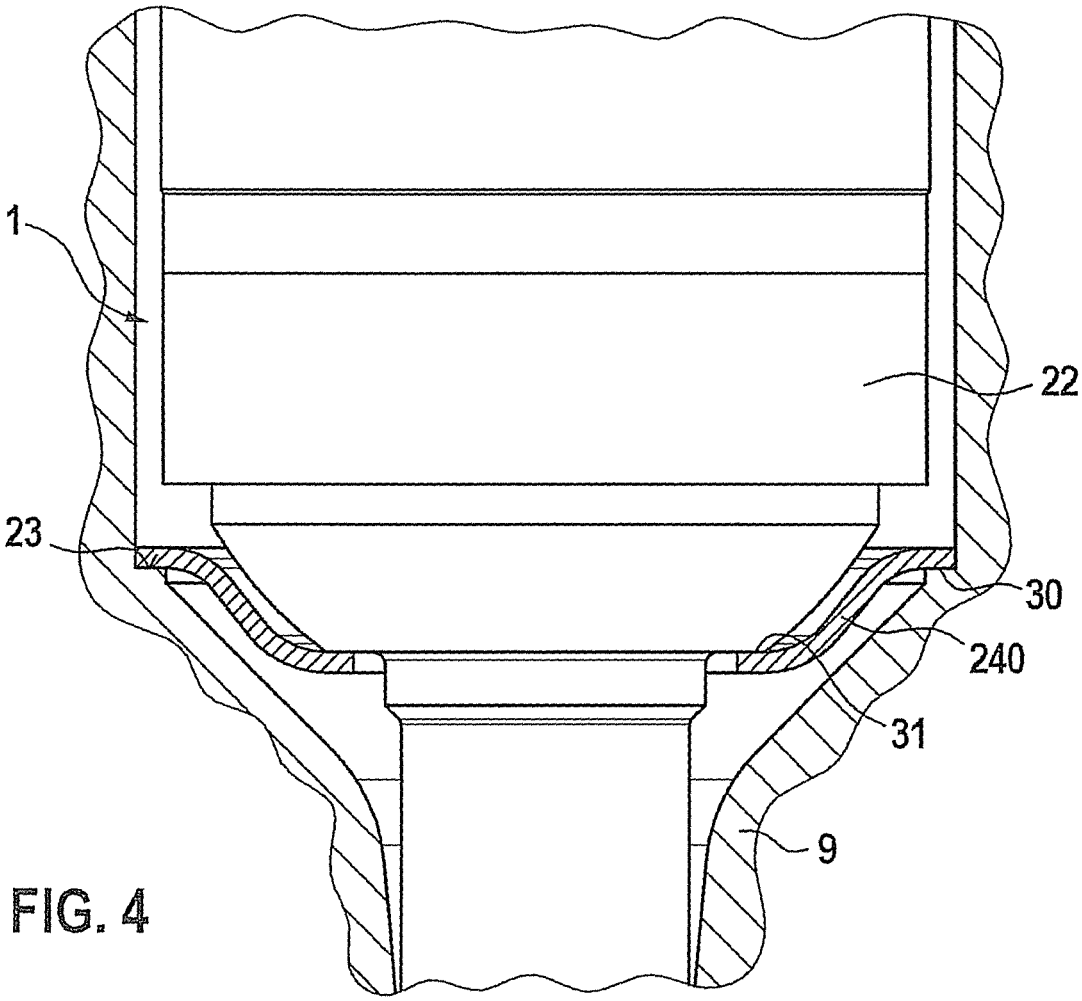
FIG. 4 shows a partial view of a fuel injection device having a decoupling element according to the present invention.
Figure 5:
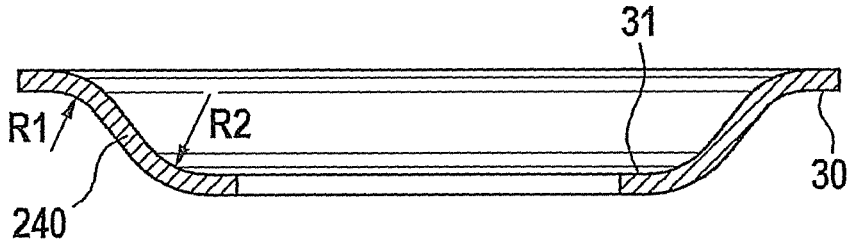
FIG. 5 shows a cross-section through a first embodiment of a decoupling element according to the present invention according to FIG. 4.

FIG. 4 shows a partial view of a fuel injection device having a decoupling element 240 according to the present invention, while FIG. 5 shows a cross-section through a first embodiment of decoupling element 240 according to FIG. 4. This example embodiment of the fuel injection device is a system for direct gasoline injection using fuel injection valves 1 that are operated with piezoactuators and that are used for example in a constant-pressure system. Decoupling element 240 is advantageously realized as a metallic perforated disk running in annular fashion. A metallic material also offers the advantage that it can be processed using economical manufacturing methods (e.g., turning, deep-drawing), in order to enable production of the desired geometries of decoupling element 240 with the required dimensions.

The spring rigidity of decoupling element 240 is selected to be low (20-40 kN/mm) relative to the mass of fuel injection valve 1, which is approximately 250 g. In this way, disturbing noise that occurs with direct fuel injection of this type, typically in a frequency range from 2.5-14 kHz, can be decoupled in targeted fashion over a broad frequency range. Decoupling resonance $f_R$ is situated here in the frequency range below 2.5 kHz, where it is masked by combustion and engine noise and is not perceived as disturbing.

The low spring rigidity of decoupling element 240 is achieved through a variety of targeted measures. Decoupling element 240 has, in the installed state, two support areas 30, 31, a radially outer support area 30 and a radial inner support area 31. With outer support area 30, decoupling element 240 is seated in annular fashion on shoulder 23, which for example runs perpendicular to the valve longitudinal axis, of receiving bore 20 in cylinder head 9. With inner support area 31, decoupling element 240 is seated under fuel injection valve 1 in annular fashion in an area in which valve housing 22 for example also has an outer contour that runs perpendicular to the valve longitudinal axis, so that fuel injection valve 1 abuts the inner edge area of decoupling element 240. The situation of the two support areas 30, 31 of decoupling element 240 is chosen such that the maximum possible lever arm results. In the depicted exemplary embodiment, these support areas 30, 31 are thus placed at the edge areas on the outer diameter and on the inner diameter of decoupling element 240 that are as far as possible from each other.

The cross-section of decoupling element 240 has an S-shaped contour having two large radii R1, R2 oriented toward outer and inner support area 30, 31, whose common limbs merge with one another tangentially. Overall, decoupling element 240 thus has a bowl shape or plate shape. With this design, the typically small constructive space available in receiving bore 20 of cylinder head 9 is also optimally used in order to achieve a lever arm that is as long as possible. The two radii R1, R2 of this contour are selected, in their size and their relation to one another, in such a way that a distribution of tension in the material results that is as advantageous as possible, and the prespecified rigidity characteristic is optimally fulfilled. In the present case, this would be for example an upper radius R1 of 2 mm and a lower radius R2 of 2.5 mm.

The bowl-shaped design of decoupling element 240 makes it possible to use material thicknesses sufficient for the strength of decoupling element 240, with a simultaneously low overall spring rigidity of decoupling element 240. With the use of a metallic material, a material thickness on the order of magnitude of 0.5 mm can be suitable. The thickness of the material can however also be varied over the radial extension of a decoupling element 240 in order to achieve an optimized rigidity characteristic.

Figure 6:
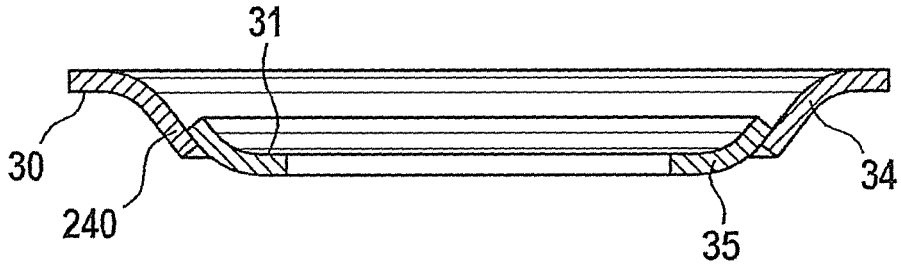
FIG. 6 shows a cross-section through a second embodiment of a decoupling element according to the present invention, in a two-part solution.

FIG. 6 shows a cross-section through a second embodiment of a decoupling element 240 according to the present invention, in a two-part solution. This decoupling element 240 also has a bowl-shaped design. This variant embodiment takes into account assembly requirements that may result in a more pronounced oblique positioning of fuel injection valve 1. For this reason, decoupling element 240 is divided into two sub-elements 34, 35 situated in one another. While the radially outer, and therefore upper, sub-element 34 includes radially outer support area 30, and runs with radius R1 bent outward, the radially inner, and therefore lower, sub-element 35 is provided with radially inner support area 31, and its radius R2 is bent inward. Inner sub-element 35 is placed into outer sub-element 34. Together, sub-elements 34, 35 of decoupling element 240 permit a slight shifting in order to compensate an oblique positioning, but their overall behavior adheres to the desired design goal.

Figure 7:
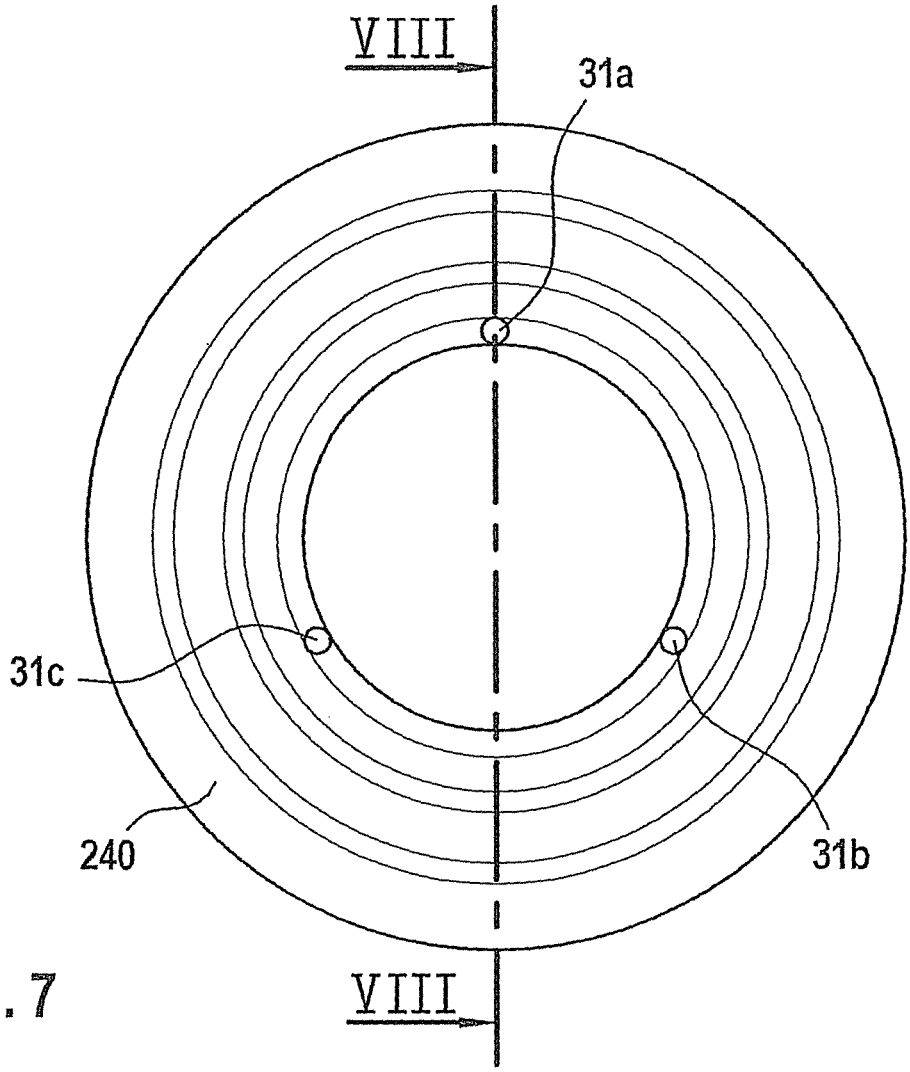
FIG. 7 shows a third embodiment of a decoupling element according to the present invention, in a top view.
Figure 8:
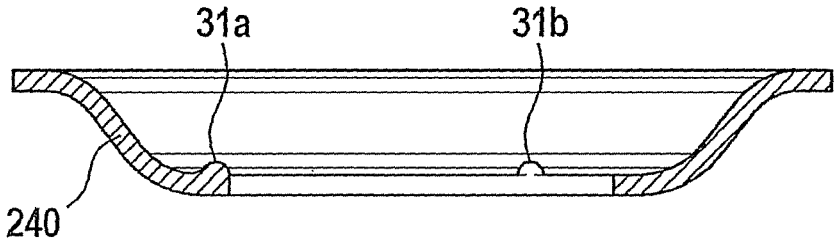
FIG. 8 shows a cross-section through the decoupling element according to the present invention, along the line VIII-VIII in FIG. 7.

A third example embodiment of a decoupling element 240 according to the present invention is shown in FIG. 7 in a top view. FIG. 8 shows a cross-section through decoupling element 240 according to the present invention, along the line VIII-VIII in FIG. 7. This variant embodiment of decoupling element 240 is distinguished in that radially inner support area 31 is modified relative to the previously described solutions. Instead of a support area 34 that runs annularly around decoupling element 240, a plurality of support points situated at a distance from one another 31*a*, 31*b*, 31*c* are provided that, if there are three support points 31*a*, 31*b*, 31*c*, are for example distributed at a distance of 120° from one another. Such a variant embodiment also takes into account the possibility of an oblique positioning of fuel injection valve 1 due to conical support points 31*a*, 31*b*, 31*c* formed on decoupling element 240, within which fuel injection valve 1 can be oriented.

Figure 9:
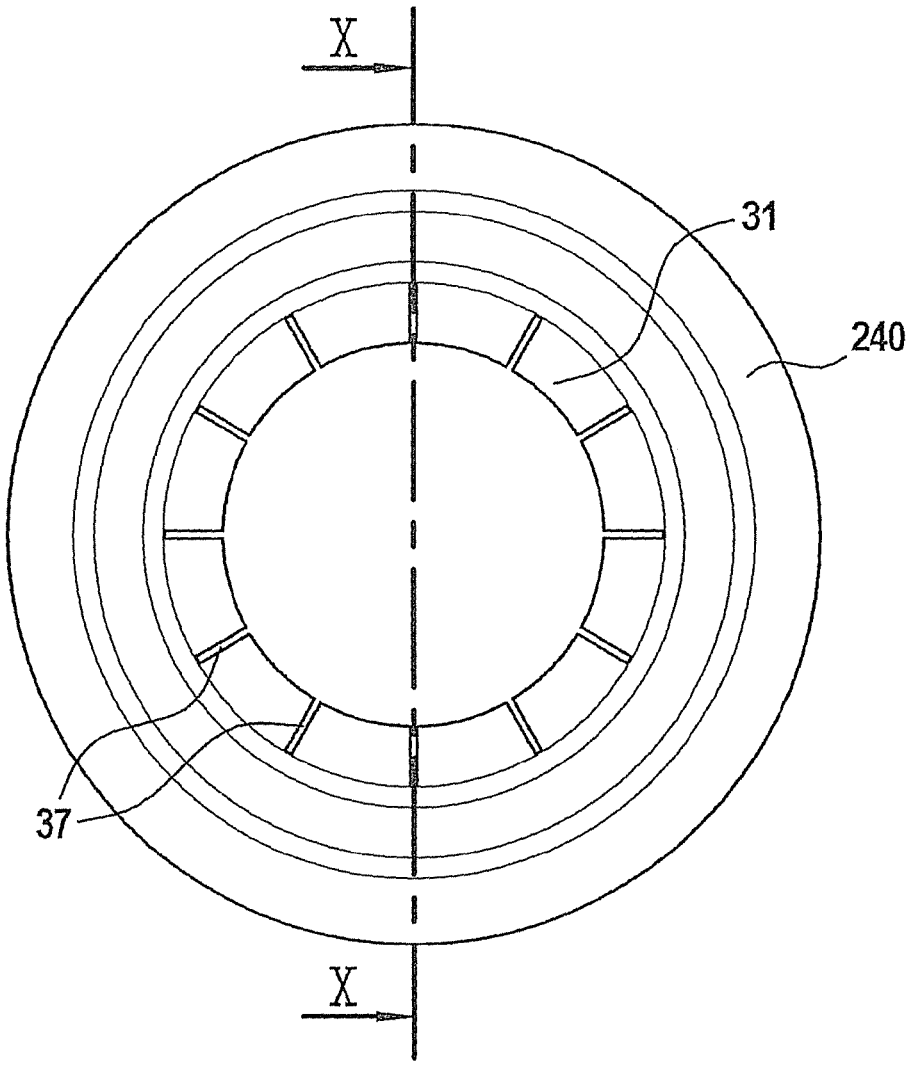
FIG. 9 shows a fourth embodiment of a decoupling element according to the present invention, in a top view.
Figure 10:
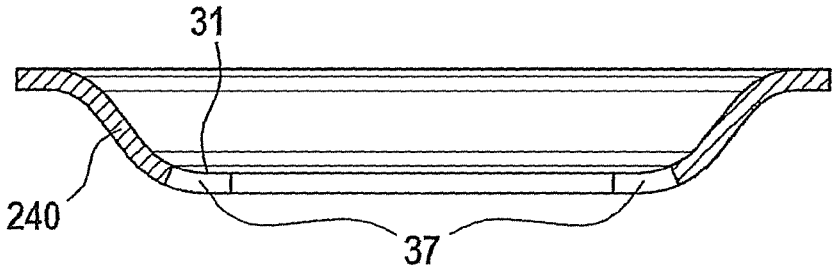
FIG. 10 shows a cross-section through the decoupling element according to the present invention, along the line X-X in FIG. 9.

A fourth example embodiment of a decoupling element 240 according to the present invention is shown in a top view in FIG. 9. FIG. 10 shows a cross-section through decoupling element 240 according to the present invention along the line X-X in FIG. 9. This further variant embodiment captures a possible oblique positioning of fuel injection valve 1 through a local weakening of inner support area 31. This local weakening of radially inner support area 31 is achieved for example by slits 37 that run radially, going out from the inner diameter of decoupling element 240 and running for example up to inner radius R2. Typically, these slits 37, or other openings that reduce rigidity, can be present in a quantity of from three to twenty.

Figure 11:
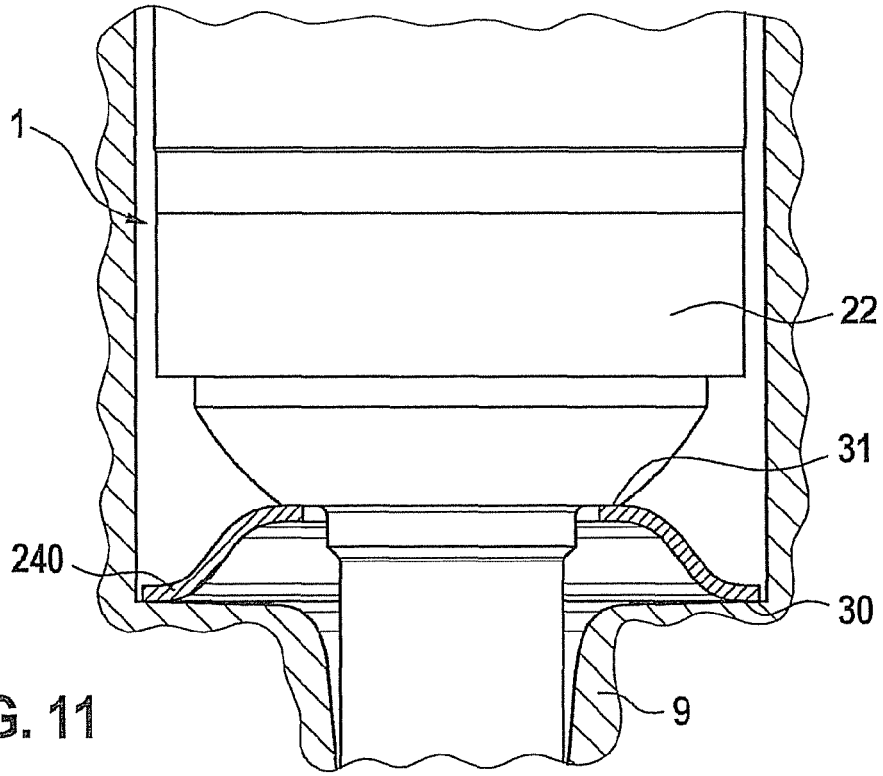
FIG. 11 shows a partial view of a fuel injection device having a fifth decoupling element according to the present invention.
Figure 12:
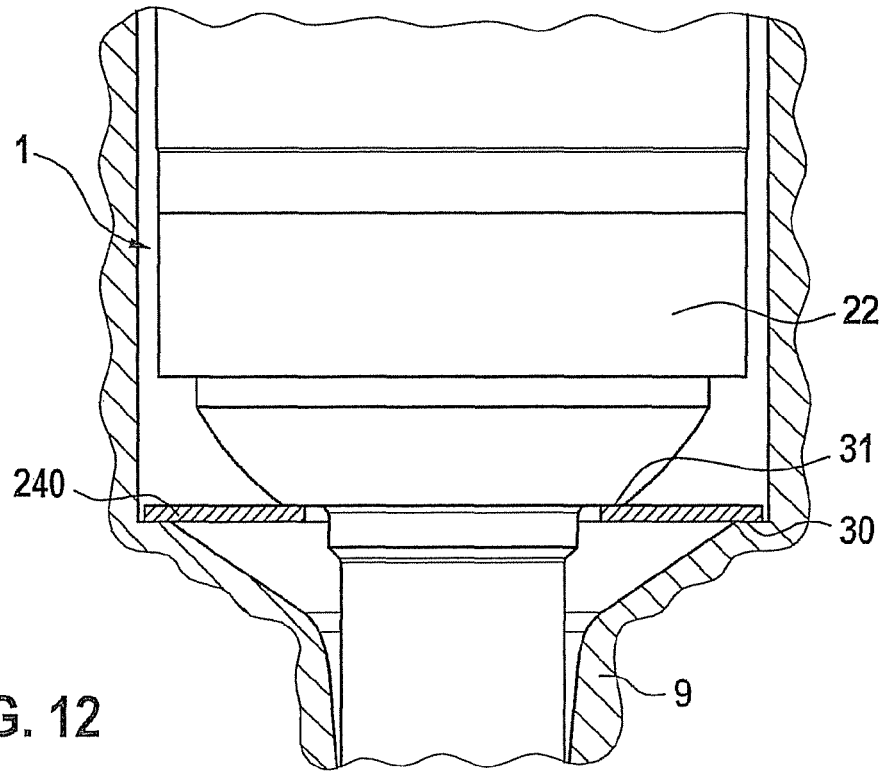
FIG. 12 shows a partial view of a fuel injection device having a sixth decoupling element according to the present invention.

FIGS. 11 and 12 show partial views of two further fuel injection devices, provided with a fifth or, respectively, sixth decoupling element 240 according to the present invention. Decoupling element 240 shown in FIG. 11 differs from decoupling element 240 shown in particular in FIGS. 4 and 5 by its inverse, upward-oriented curvature. Decoupling element 240 is again bowl-shaped or plate-shaped, but is installed in a reversed position; i.e., radially outer support area 30 on shoulder 23 of cylinder head 9 is situated lower than is radially inner support area 31 on valve housing 22 of fuel injection valve 1.

The exemplary embodiment shown in FIG. 12 indicates that decoupling element 240 can also be realized in the form of a flat disk. For both the variant embodiments of decoupling elements 240 shown in FIGS. 11 and 12, however, the demands described in detail above regarding spring rigidity and the required distance of support areas 30, 31 from one another still hold. Corresponding to the desired rigidity characteristic, here as well the material thickness can vary over the radial extension of decoupling element 240.

On the basis of the diagrams shown in FIGS. 13 and 14, it is again illustrated how, through a targeted nonlinearity of the decoupling rigidity of decoupling element 240, an advantageous decoupling of fuel injection valves 1 in fuel systems can be achieved. In some systems, the fuel pressure is constantly kept high (constant-pressure system), while in other systems the system pressure is varied as a function of load or rotational speed (alternating-pressure systems); in the latter, during idling operation a lowering of the fuel pressure typically takes place.

The fuel pressure acts as a static hydraulic force on the fuel injection valve, and loads decoupling element 240 with a constant pre-load, and thus a shift. In the linear case, this shift is proportional to the force. With regard to tightness and wear of the injector connections to the fuel system and cylinder head, there are maximum limits for the permissible spring path. Therefore, according to the present invention a nonlinear relationship has been selected here between the force and the spring path for decoupling element 240.

In the case of the alternating-pressure system (FIG. 13), a progressive spring rigidity causes low rigidity when there is low system pressure, i.e., idling or low load, thus causing, according to the decoupling principle, a broad range of noise decoupling. Typically, noticeable noise is primarily found in these areas of operation. When there is higher load, and therefore higher pressure, decoupling element 240 becomes more rigid, and thus limits the path. In these areas of operation, other engine noise components then mask the injector-induced noise, which is more poorly decoupled.

In the case of a constant-pressure system (FIG. 14), a constant high pressure is present at decoupling element 240. Here, it is advantageous that when there is a pressure buildup (e.g. every time the engine is started), the spring path is limited by a high spring rigidity; during operation, however, a low rigidity is then again in effect for a broad decoupling range. This characteristic is achieved through a degressive spring characteristic.

What is claimed is:

1. A fuel injection device for a fuel injection system of internal combustion engines for direct injection of fuel into a combustion chamber, the fuel injection device comprising:

at least one fuel injection valve and a receiving bore for the fuel injection valve; and a decoupling element positioned between a valve housing of the fuel injection valve and a wall of the receiving bore, wherein the decoupling element has a spring rigidity to provide a decoupling resonance that is located in a frequency range below 2.5 kHz in order to reduce undesired noise excitation in a surrounding structure, the decoupling element is made from a metallic material, the decoupling element has a radially outer support area and radially inner support area with which the decoupling element can be supported radially outwardly in annular fashion against a shoulder of the receiving bore, and the fuel injection valve can be supported radially inwardly from below against the decoupling element.

2. The fuel injection device as recited in claim 1, wherein the spring rigidity of the decoupling element is in a range from 20-40 kN/mm.

3. The fuel injection device as recited in claim 1, wherein the radially outer support area and the radially inner support area are situated at a distance from one another that is great enough that a maximum possible lever arm results.

4. The fuel injection device as recited in claim 1, wherein the radially inner support area one of: i) runs around in annular fashion, ii) is interrupted by slits that run radially or by other openings that reduce rigidity, or iii) is formed by a plurality of support points situated at a distance from one another.

5. The fuel injection device as recited in claim 1, wherein the decoupling element has a shape of an annular disk and is fashioned so as to be one of bowl-shaped or plate-shaped overall.

6. The fuel injection device as recited in claim 5, wherein a cross-section of the decoupling element has an S-shaped contour having two radii oriented toward an outer and an inner support area.

7. The fuel injection device as recited in claim 5, wherein a material thickness of the disk-shaped decoupling element is one of: i) constant, or ii) is varied over its radial extension, in order to promote an optimized rigidity characteristic.

8. The fuel injection device as recited in claim 1, wherein the decoupling element has a nonlinear progressive spring characteristic.

9. The fuel injection device as recited in claim 1, wherein the decoupling element has a nonlinear digressive spring characteristic.

10. The fuel injection device as recited in claim 1, wherein the receiving bore for the fuel injection valve is fashioned in a cylinder head, and the receiving bore has a shoulder that runs perpendicular to an extension of the receiving bore and on which the decoupling element is partially seated with its radially outer support area, and the fuel injection valve abuts, with an outer contour of the valve housing that runs perpendicular to the valve longitudinal axis, the radially inner support area of the decoupling element.

* * * * *